US009068423B2

(12) United States Patent
Johnson et al.

(10) Patent No.: US 9,068,423 B2
(45) **Date of Patent: *Jun. 30, 2015**

(54) WELLHEAD CONNECTOR AND METHOD OF USING SAME

(75) Inventors: Christopher Dale Johnson, Cypress, TX (US); James William Weir, Houston, TX (US); Dean Allen Bennett, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 601 days.

This patent is subject to a terminal disclaimer.

(21) Appl. No.: 13/365,976

(22) Filed: Feb. 3, 2012

(65) Prior Publication Data

US 2013/0199801 A1 Aug. 8, 2013

(51) Int. Cl.
*E21B 33/12* (2006.01)
*E21B 33/04* (2006.01)
*E21B 33/038* (2006.01)

(52) U.S. Cl.
CPC ..... *E21B 33/038* (2013.01)

(58) Field of Classification Search
CPC ... E21B 33/038; E21B 33/0355; E21B 33/03; E21B 33/035
USPC ..... 166/368, 344, 379, 85.4, 360, 387, 345
See application file for complete search history.

(56) References Cited

U.S. PATENT DOCUMENTS 2,609,836 A 9/1952 Knox
3,084,898 A 4/1963 Miller
3,485,051 A 12/1969 Watkins
3,492,027 A 1/1970 Herring
3,667,721 A 6/1972 Vujasinovic
4,310,139 A 1/1982 Williams, III et al.
4,431,215 A 2/1984 Moyer
4,479,506 A 10/1984 Goans
4,496,172 A 1/1985 Walker
4,516,795 A 5/1985 Baugh (Continued)

FOREIGN PATENT DOCUMENTS

CN 202064876 12/2011
GB 2112432 7/1983

(Continued)

OTHER PUBLICATIONS

Cameron: Drilling Systems—DL Annular Blowout Preventer, product specifications, [online], [retrieved on Nov. 8, 2011]. Retrieved from the Internet: <URL: http://www.c-a-m.com/forms/Product.aspx?prodID=ecd6ef4e-19dc-4ea-ad47-94689e36b61c>.

(Continued)

*Primary Examiner* — Nicole Coy
(74) *Attorney, Agent, or Firm* — JL Salazar Law Firm

(57) ABSTRACT

The techniques herein relate to a blowout preventer a wellhead of a wellbore penetrating a subterranean formation. The blowout preventer includes a housing having a bore therethrough, a segment carrier positionable in the housing, and a piston. The segment carrier includes a carrier ring for receiving the mandrel and a plurality of segments pivotally movable radially thereabout. The piston is operatively connectable to the plurality of segments and actuatable for moving the plurality of segments between a disengaged and an engaged position about the mandrel.

24 Claims, 7 Drawing Sheets

(56) References Cited

U.S. PATENT DOCUMENTS

| | | | | |
|---|---|---|---|---|
| 4,526,406 | A | 7/1985 | Nelson | |
| 4,557,508 | A | 12/1985 | Walker | |
| 4,606,555 | A | 8/1986 | Adams | |
| 4,606,557 | A | 8/1986 | Coffey | |
| 4,630,680 | A | 12/1986 | Elkins | |
| 4,693,497 | A | 9/1987 | Pettus et al. | |
| 4,708,376 | A * | 11/1987 | Jennings et al. | 285/315 |
| 4,709,726 | A | 12/1987 | Fitzgibbons | |
| 4,902,044 | A | 2/1990 | Williams et al. | |
| 4,902,045 | A | 2/1990 | McGugan et al. | |
| 4,904,228 | A | 2/1990 | Frear et al. | |
| 5,116,017 | A | 5/1992 | Granger et al. | |
| 5,143,158 | A | 9/1992 | Watkins et al. | |
| 5,178,215 | A | 1/1993 | Yenulis et al. | |
| 5,305,838 | A | 4/1994 | Pauc | |
| 5,332,043 | A | 7/1994 | Ferguson | |
| 5,507,467 | A | 4/1996 | Mott | |
| 5,588,491 | A | 12/1996 | Brugman et al. | |
| 5,662,171 | A | 9/1997 | Brugman et al. | |
| 5,971,076 | A | 10/1999 | Taylor et al. | |
| 6,016,880 | A | 1/2000 | Hall et al. | |
| 6,070,669 | A | 6/2000 | Radi et al. | |
| 6,089,321 | A | 7/2000 | Morrill | |
| 6,129,149 | A | 10/2000 | Beall | |
| 6,609,572 | B1 | 8/2003 | Anderson et al. | |
| 6,609,734 | B1 | 8/2003 | Baugh | |
| 6,966,382 | B2 | 11/2005 | Buckle et al. | |
| 7,367,396 | B2 | 5/2008 | Springett et al. | |
| 7,614,453 | B2 | 11/2009 | Spiering et al. | |
| 7,779,918 | B2 * | 8/2010 | Cowie et al. | 166/373 |
| 7,814,979 | B2 | 10/2010 | Springett et al. | |
| 8,016,042 | B2 | 9/2011 | Spiering et al. | |
| 8,474,537 | B2 | 7/2013 | Voss et al. | |
| 2003/0106693 | A1 | 6/2003 | Jennings et al. | |
| 2003/0151254 | A1 | 8/2003 | Baugh | |
| 2004/0102069 | A1 | 5/2004 | Singeetham et al. | |
| 2005/0034870 | A1 | 2/2005 | Buckle et al. | |
| 2005/0269102 | A1 | 12/2005 | McCanna et al. | |
| 2006/0197339 | A1 | 9/2006 | Oestergaard et al. | |
| 2009/0014184 | A1 | 1/2009 | Voss et al. | |
| 2010/0006298 | A1 | 1/2010 | Voss et al. | |
| 2010/0078174 | A1 | 4/2010 | Spiering et al. | |
| 2010/0155074 | A1 | 6/2010 | Rodriguez | |
| 2011/0000670 | A1 | 1/2011 | Springett et al. | |
| 2013/0175055 | A1 | 7/2013 | Hart et al. | |
| 2013/0199801 | A1 | 8/2013 | Johnson et al. | |
| 2013/0199802 | A1 | 8/2013 | Weir et al. | |
| 2013/0264070 | A1 | 10/2013 | Miller et al. | |
| 2014/0318809 | A1 | 10/2014 | Joensen et al. | |

FOREIGN PATENT DOCUMENTS

| | | |
|---|---|---|
| GB | 2406151 | 3/2005 |
| WO | 20050108739 | 11/2005 |
| WO | 2013098560 | 7/2013 |
| WO | 2013152233 | 10/2013 |

OTHER PUBLICATIONS

GE Oil & Gas: Hydril Pressure Control Annu-Flex, product specifications, [online], [retrieved on Nov. 8, 2011]. Retrieved from the Internet: <URL: http://hydrilpressurecontrol.com/_pdf/pressureControlBrochures/GE_HY_Annu-Flex_FS_080610.pdf>.

Integrated Equipment: Products: Elastomer Products—Annular BOP Seal Kits, product specifications, [online], [retrieved on Jan. 8, 2011]. Retrieved from the Internet: <URL: http://www.integratedequipment.com/annular_bop_sealkits.asp>.

T3 Energy Services: 7022 Annular BOP, product specifications, [online], [retrieved on Jan. 8, 2011]. Retrieved from the Internet: <URL: http://www.t3energy.com/Portals/0/pdfs/pdf/7022%20Annular%20BOP.pdf>.

T3 Energy Services: 7072 BOPS, product specifications, [online], [retrieved on Jan. 8, 2011]. Retrieved from the Internet: <URL: http://www.t3energy.com/Portals/01/pdfs/pdf/7072%20BOP.pdf>.

T3 Energy Services: 7082 BOPS, product specifications, [online], [retrieved on Jan. 8, 2011]. Retrieved from the Internet: <URL: http://www.t3energy.com/Portals/0/pdfs/pdf/7082%20BOP.pdf>.

Wikipedia (online free encyclopedia) [online], Blowout preventer, [retrieved Jan. 8, 2011]. Retrieved from the Internet: <URL: http://en.wikipedia.org/wiki/Blowout_preventer>.

Examination Report for EPO Patent Application No. 13705052.2 dated Oct. 10, 2014, 2 pages.

International Preliminary Report on Patentability and Written Opinion for PCT/US2013/023671 dated Aug. 5, 2014, 7 pages.

Akers, T.J., et al., "Formation and Removal of Hydrates inside wellhead connectors", SPE 124409, SPE Annual Technical Conference and Exhibition held in New Orleans, Oct. 1, 2009, 15 pages.

International Search Report for PCT Patent Application No. PCT/US2013/035269 dated Mar. 28, 2014, 5 pages.

Cooper Cameron Corporation, Cameron Division product brochure "Collect Connector Comparison" (Jun. 1999) 8 pages.

Dril-Quip, Inc. product brochure "DX Series Subsea Connectors" (2008) 8 pages.

VetcoGray product brochure "H-4 Subsea Connectors" (2008) 7 pages.

GE Oil & Gas product brochure "Hydril Pressure Control Annu-Flec TM" (2010) 2 pages.

GE Oil & Gas product brochure "Hydril Pressure Control GK Annular Blowout Preventer" (2010) 2 pages.

GE Oil & Gas product brochure Hydril Pressure Control GL Annular Blowout Preventer (2010) 2 pages.

GE Oil & Gas product brochure "Hydril Pressure Control GX Annular Blowout Preventer" (2010) 2 pages.

GE Oil & Gas product brochure "VetcoGray Subsea Wellhead Systems" (2009) 12 pages.

Invitation to Pay Additional Fees and, Where Applicable, Protest Fee for PCT Patent Application No. PCT/US2013/035332 dated Mar. 28, 2014, 5 pages.

International Search Report for PCT Patent Application No. PCT/US2013/035332 dated Jun. 2, 2014, 7 pages.

International Search Report for PCT Patent Application No. PCT/US2013/035280 dated Mar. 28, 2014, 4 pages.

International Premliminary Report on Patentability and Written Opinion for PCT Application No. PCT/US2013/035269 dated Oct. 7, 2014, 9 pages.

International Preliminary Report on Patentability and Written Opinion for PCT/US2013/035280 dated Oct. 7, 2014, 9 pages.

International Search Report for PCT Patent Application No. PCT/US2013/023671 dated Feb. 26, 2014, 5 pages.

* cited by examiner

WELLHEAD CONNECTOR AND METHOD OF USING SAME

BACKGROUND

This present invention relates generally to techniques for performing wellsite operations. More specifically, the present invention relates to techniques for sealing a wellhead of a wellbore.

Various oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars (or tubular strings) may be provided for passing subsurface fluids to the surface.

A wellhead may be provided about a top of the wellbore for supporting casings and/or tubulars in the wellbore. A wellhead connector may be provided for connecting the wellhead to surface components, such as a blowout preventer (BOP) and/or a Christmas tree. Examples of wellhead connectors are described in U.S. Pat. Nos. 4,606,555 and 5,332,043.

Leakage of subsurface fluids may pose an environmental threat if released from the wellbore. A BOP may be positioned about the wellbore to form a seal about the tubular therein to prevent leakage of fluid as it is brought to the surface. Some BOPs may have selectively actuatable rams or ram bonnets, such as pipe or shear rams, for sealing and/or severing a tubular in a wellbore. Examples of BOPs and/or rams are provided in U.S. Pat. Nos. 7,367,396, 7,8149,79, and 2011/0000670. Some BOPs may be spherical (or rotating or rotary) BOPs as described, for example, in U.S. Pat. Nos. 5,588,491 and 5,662,171.

SUMMARY

The techniques herein relate to a wellhead connector and related methods for sealing a wellhead. The wellhead connector includes a housing having a bore therethrough, a mandrel operatively connectable to the housing and the wellhead (the mandrel having a bore therethrough in fluid communication with the bore of the housing and the wellhead), a segment carrier positionable in the housing (the segment carrier including a carrier ring for receiving the lower flange and segments pivotally movable radially thereabout), and a piston operatively connectable to the segments. The piston is actuatable for moving the segments between a disengaged and an engaged position about the mandrel whereby the wellhead is selectively sealed.

The piston may include upper and lower piston rings with rods positioned therebetween, and be pressure balanced in the housing. The wellhead connector may also include linkages for operatively connecting the rods to the segments. The segments may be self-lockable by moving the linkages to an over-centered position normal to the rods. In the engaged position, the segments may converge and in the dis-engaged position the segments may diverge about the mandrel. The segments may include cutting tips for cutting through at least a portion of the mandrel, contact surfaces for deforming the mandrel, seals for forming a seal about the mandrel, grips for grippingly engaging the mandrel. The mandrel may have a neck portion for receiving the segments, and a flange end operatively connectable to the wellhead. The mandrel may be receivable in the housing through the receptacle and operatively connectable to a downhole end of the upper flange. The housing may include a tubular body, an upper flange and a lower receptacle. The wellhead connector may also have locking dogs for operatively connecting the upper flange and the lower receptacle to the housing. The wellhead connector, an actuator for actuating the piston and a controller may be part of a wellhead system.

The wellhead connector may be provided as part of a method of sealing a wellhead involving operatively connecting the mandrel the housing and the wellhead, and actuating the piston to selectively move the segments between a disengaged position and an engaged position about the mandrel. The method may also involve forming a seal about the mandrel with the segments, deforming the mandrel with the segments, cutting the mandrel with the segments, and/or slidably moving the piston in the housing. The actuating may involve slidably moving the piston in the housing such that the linkages rotate the segments. The method may also involve self-locking the segments by moving the linkages to an over-centered position normal to the rods and/or pressure balancing the piston within the housing.

BRIEF DESCRIPTION DRAWINGS

So that the above recited features and advantages can be understood in detail, a more particular description, briefly summarized above, maybe had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

DETAILED DESCRIPTION

The description that follows includes exemplary systems, apparatuses, methods, and instruction sequences that embody techniques of the subject matter herein. However, it is understood that the described embodiments may be practiced without these specific details.

The disclosure relates to a wellhead connector with an engagement assembly for sealing a wellhead. Scaling as used herein may relate to contacting, deforming, cutting (e.g., puncturing, piercing, severing or otherwise passing through at least a portion the wellhead), fluidly isolating and/or sealing part or all of the wellhead (and/or wellbore). The wellhead connector may be positioned about the wellhead for sealing the wellhead (e.g., in the event of a leak, a blowout, or other occurrence). The wellhead connector may have a cylindrical configuration with a mandrel for connection with the wellhead, and may be provided with a pressure-balanced piston for activating wedge-shaped segments to engage the mandrel. The cylindrical configuration and pressure balanced piston may be used to reduce and/or balance pressure effects of the wellhead connector. The wellhead connector may be used to achieve one or more of the following, among others: reduced pressure, modular components, reduced weight, enhanced efficiency, reduced cost, locking and/or self-locking capabilities, etc.

Figure 1:
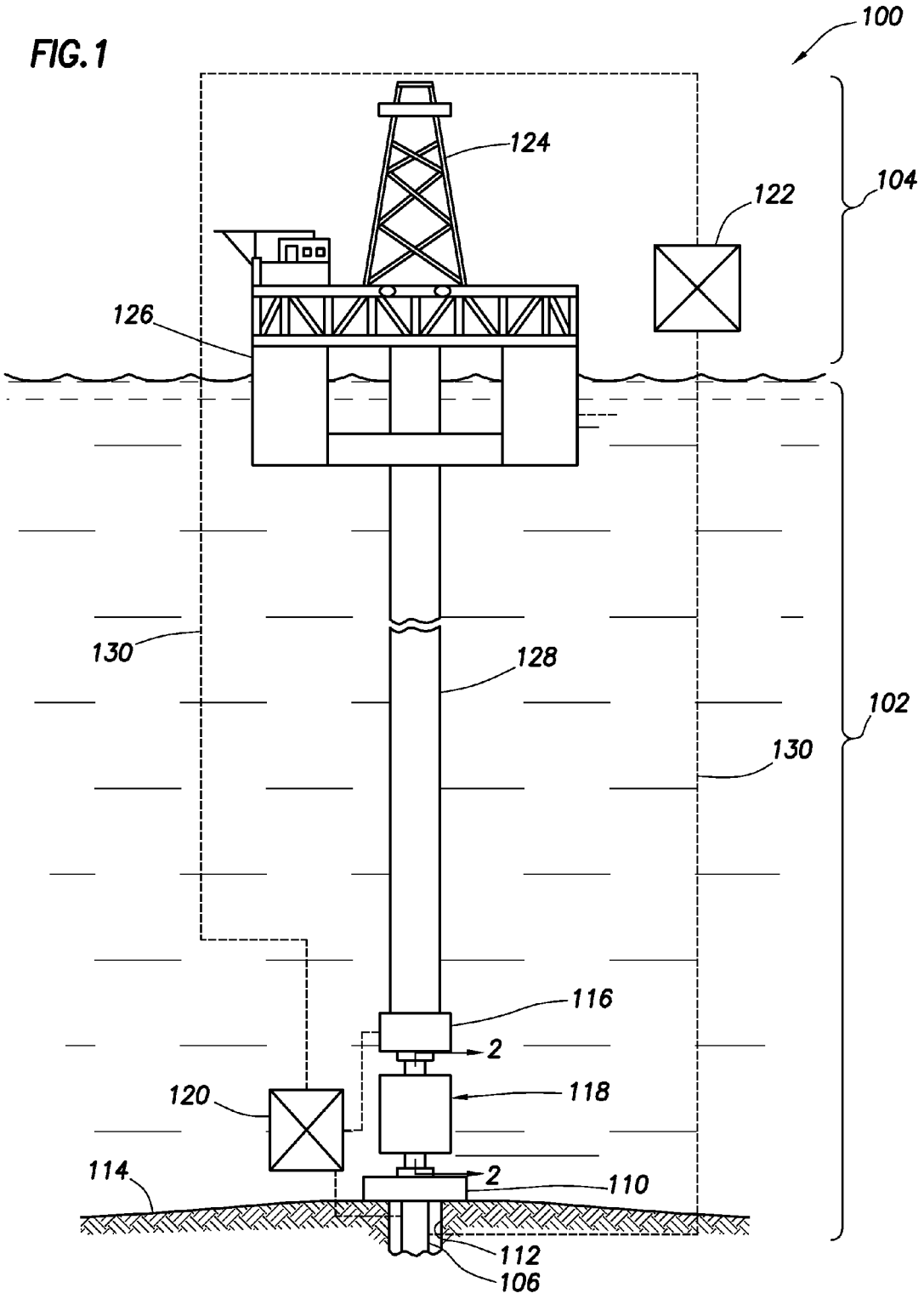
FIG. 1 is a schematic view of an offshore wellsite having a wellhead connector positionable about a wellhead, the wellhead connector having an engagement assembly.

FIG. 1 depicts an offshore wellsite 100 having a subsea system 102 and a surface system 104. The wellsite 100 is described as being a subsea operation, but may be for any wellsite environment (e.g., land or water based). The subsea system 102 includes a tubular 106 extending from a wellhead 110 and into a wellbore 112 in a sea floor 114. A wellhead connector 118 is positioned above the wellhead 110 for sealing as will be described further herein. A BOP 116 is shown connected above the wellhead connector 118. One or more other components may be connected above and/or below the wellhead connector 118 and/or the BOP 116. For example, the subsea system 102 may have various devices, such as a stripper and a tubing delivery system (not shown). A controller 120 is provided for operating, monitoring and/or controlling the wellhead connector 118, the BOP 116 and/or other portions of the wellsite 100.

The surface system 104 includes a rig 124, a platform 126 (or vessel), a tubing 128 and a surface controller 122. The tubing 128 extends from the platform 126 to the BOP 116 for passing fluid to the surface. Part or all of the tubing 128 and/or tubular 106 may pass through the wellhead connector 118 and/or BOP 116 for fluid communication therebetween. The surface controller 122 is provided for operating, monitoring and/or controlling the rig 124, platform 126 and/or other portions of the wellsite 100.

As shown the surface controller 122 is at a surface location and the subsea controller 120 is at a subsea location. However, it will be appreciated that the one or more controllers 120/122 may be located at various locations to control the surface 104 and/or the subsea systems 102. Communication links 130 may be provided for communication with various parts of the wellsite 100, such as the controllers 120/122.

FIGS. 2A-2D and 3 show the wellhead connector 118 of FIG. 1 in greater detail. The wellhead connector 118 includes a housing 232, a mandrel 233, and an engagement assembly 235. The housing 232 is a modular tubular structure defining a pressure vessel for securing to the wellhead 110, closing around the mandrel 233, and for preventing fluid (e.g., drilling mud, gas, oil, water or other fluid) from escaping the wellbore 112 (see FIG. 1). The housing 232 may be configured to handle pressures in excess of about 16,000 psi (1125.2 kg/cm2) and various tubing diameters (e.g., about 18¾" (47.62 cm)).

The housing 232 has an upper flange 238 and a lower receptacle 240 connected thereto with a bore 241 therethrough for receiving a tubular (e.g., tubular 106 and/or tubing 128 of FIG. 1) not shown. The upper flange 238 and lower receptacle 240 may be connected to other wellsite components, such as one or more BOPs and/or other components. Locking dogs 242 or other connectors may be provided for connecting the upper flange 238 and lower receptacle 240 to the tubular body. The locking dogs 242 are distributed radially about the upper and lower flanges 238,240 for connection with the housing 232. While the housing 232 and upper and lower flanges 238 and 240 are depicted in a certain configuration as separate pieces, the housing 232 may be integral with various flanges or other components or provided in one or more pieces.

The mandrel 233 extends through the lower receptacle 240 and connects to the upper flange 242. The mandrel 233 is a tubular component with a bore therethrough in fluid communication with the bore 241 for passing a tubular, such as tubular 106, tubing 128 and/or fluids therethrough. A lower end of the mandrel 233 is connectable directly or indirectly (e.g., by additional components) to a wellhead 110. In some versions, the mandrel 233 may be integral with the wellhead 110. An upper end of the mandrel 233 may be connected to a lower end of the upper flange 242.

The engagement assembly 118 includes a piston 234 and a carrier 236 actuatable by an actuator 237. The piston 234 is a cylindrical component slidably positionable in the housing 232 along the upper flange 238 and the lower receptacle 240. The housing 232 has an inner surface shaped to receive the piston 234. The upper flange 238 has a shoulder defining an upper piston channel 244 between the upper flange 238 and the housing 232. The lower receptacle 240 has a shoulder defining a lower piston channel 246 between the lower flange 240 and the housing 232. The upper and lower piston channels 244,246 arc configured to receive the piston 234.

The actuator 237 may be, for example, a hydraulic actuator for adjusting pressure in the upper and/or lower piston channels 244, 246 for selectively moving the piston 234. The housing 232 may have a port (not shown) for selectively releasing pressure. The piston 234 may be slidably movable in the upper piston channel 244 and the lower piston channel 246, respectively. The piston 234 may be used to provide a balanced pressure configuration within the cylindrical housing 232. The piston 234 is positionable in the housing 232 such that internal pressure is 'cancelled out' during operation. The piston 234 includes elliptical piston rings 248, 250 on each end thereof with a plurality of rods 254 positioned radially thereabout between the piston rings 248, 250. Linkages 256 are pivotally connected to the rods 254. Various connectors 251 may be provided for securing the rods 254 in position. In the pressure balanced configuration, the piston 234 is movable within the piston channels 244, 246 for interaction with the segments 260 of carrier 236 such that pressure is distributed thereabout.

The carrier 236 includes an elliptical ring 258 positioned in the housing 232 adjacent the upper flange 238. Bolts 239 may be used to secure the elliptical carrier ring 258 to the lower receptacle 238. The elliptical carrier ring 258 has a plurality of segments 260 pivotally connected thereto. The segments 260 are positionable radially about the elliptical ring 258 and coupled to the linkages 256. Movement of the piston 254 through the housing 232 may be used to move the linkages 256 and the segments 260 connected thereto. Thus, the movement of the piston 234 and linkages 256 may be used to selectively move the segments 260.

Figure 2A:
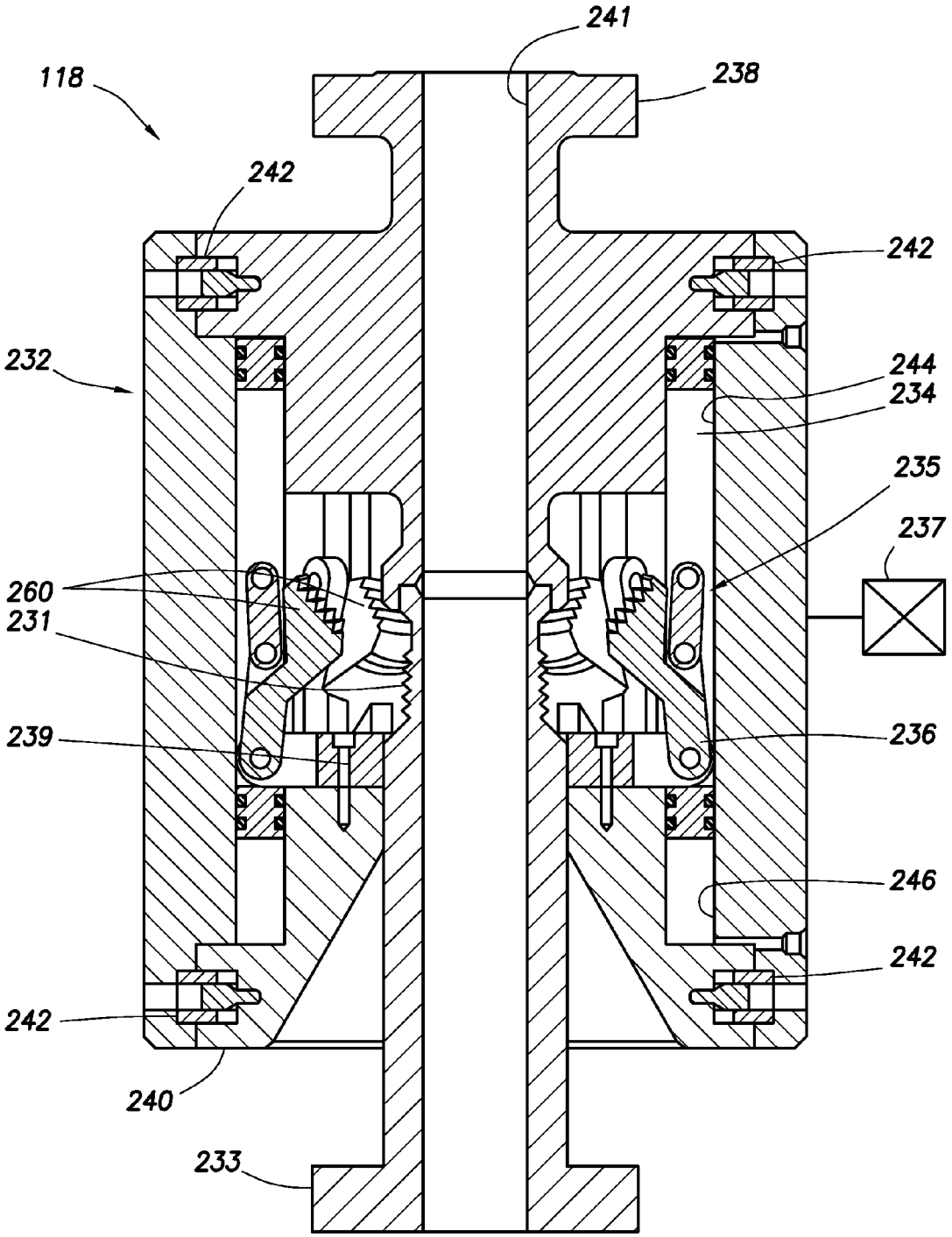
FIGS. 2A-2D are cross-sectional views of the wellhead connector of FIG. 1 taken along line 2-2 depicting operation thereof.

FIGS. 2A-2D show the piston 234 and the carrier 236 in various positions. As shown in FIG. 2A, the piston 234 is in an extended position at an upper end of the housing 232 with the linkages 256 in linear alignment with rods 254. In this position, the linkages 256 are retracted and the segments 260 are in a disengaged position away from the mandrel 233.

Figure 2B:
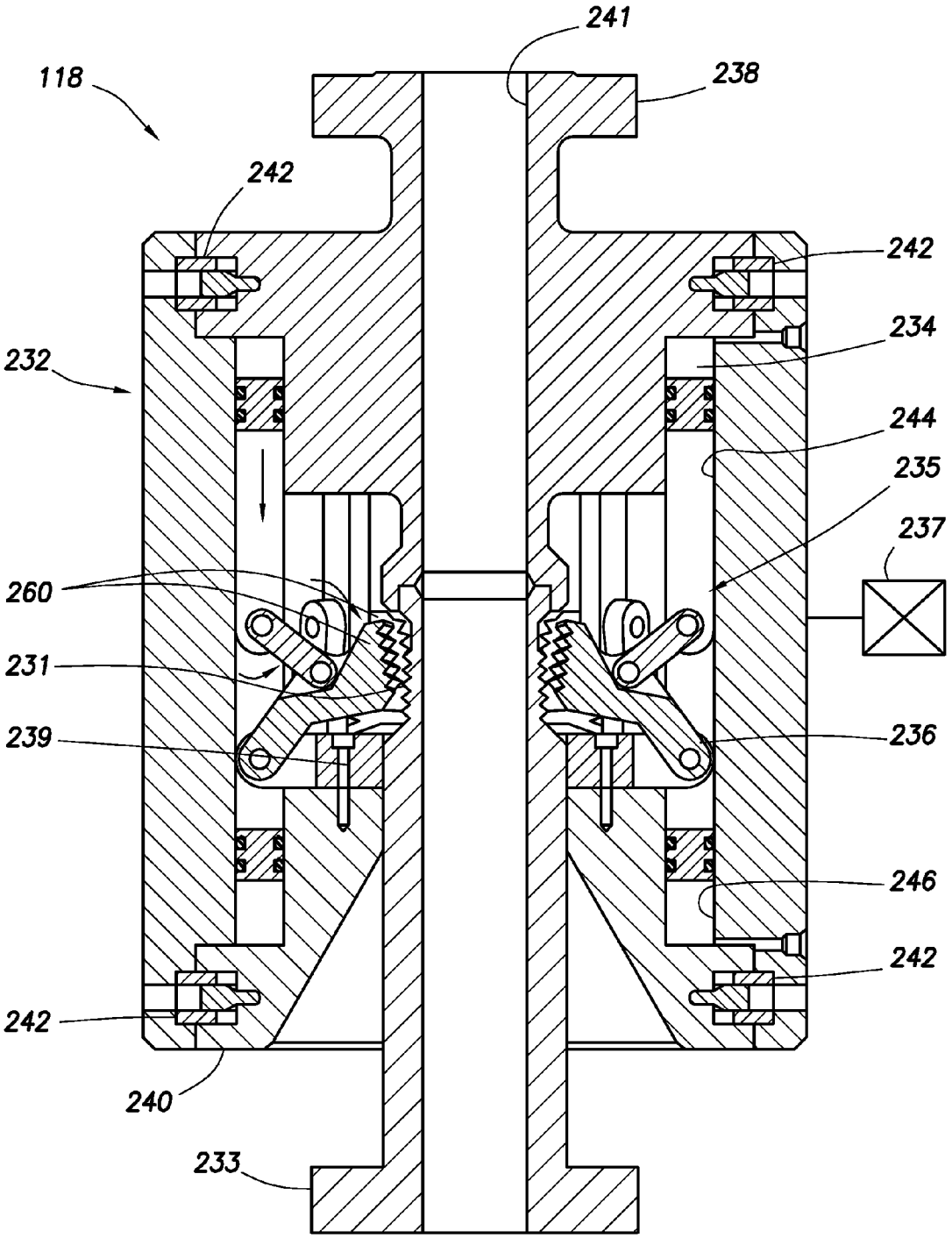
Figure 2C:
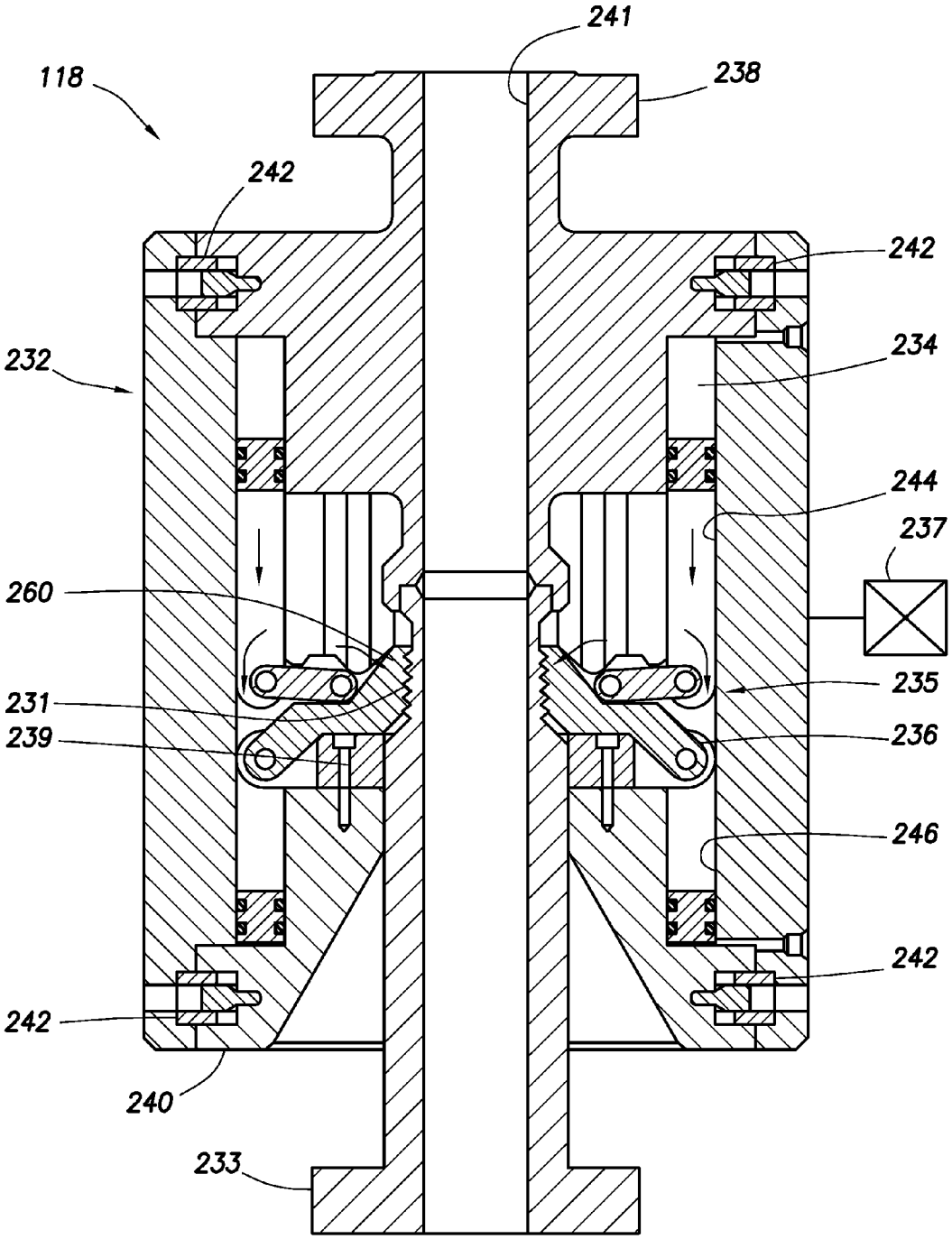

The linkages 256 are pivotally movable about the rods 254 to an extended position as the piston 234 slides downwardly within the housing 232. FIGS. 2B-2C have directional arrows showing the piston 234 as it moves downwards to the lower piston channel 246, and the linkages 256 are moved to the extended position of FIG. 2D.

Figure 2D:
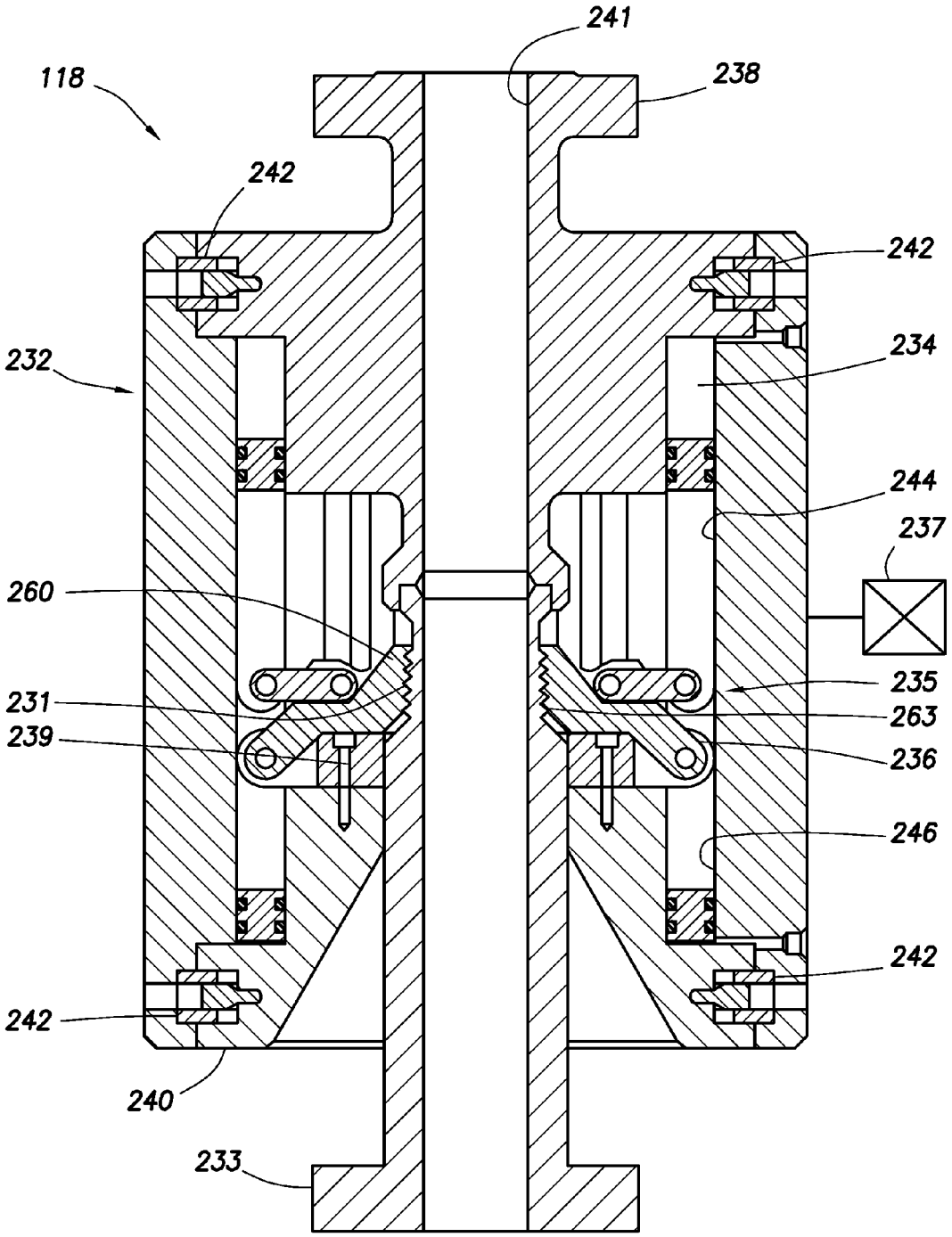
Figure 3:
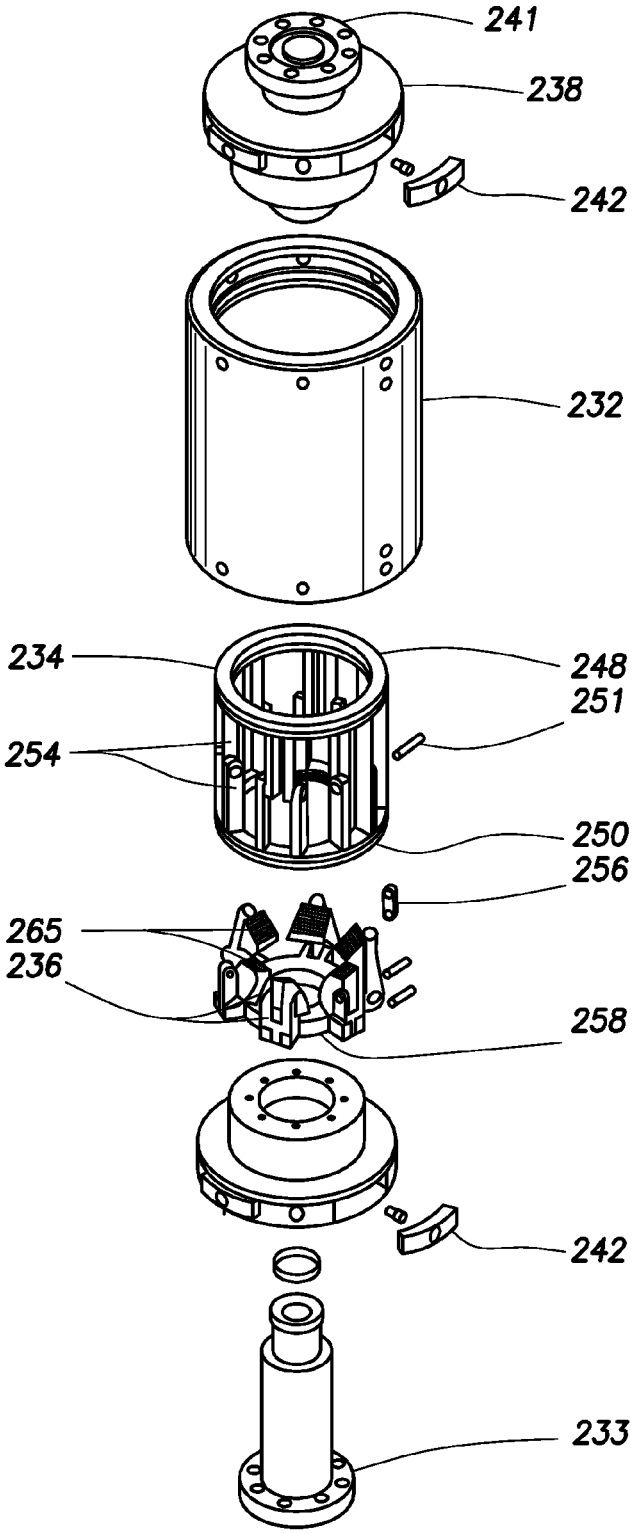
FIG. 3 is an exploded view of the wellhead connector of FIG. 1.

The linkages 256 may be pivotally rotated to an extended (or horizontal) position perpendicular to the rods 254. As the linkages 256 rotate, the segments 260 are pivotally rotated to an engaged (or converged) position about the mandrel 233 as shown in FIG. 2D. The segments 260 arc positionable about the mandrel 233 at various positions and/or variable diameters. The segments 260 are configurable to a desired pipe and/or engagement diameter. The stroke and/or dimensions of the piston 234 may be adjusted such that the linkages 256 move the segments 260 to achieve the desired engagement diameter and/or engagement force.

The piston 234 may also be configured to be 'self-locking' by positioning the linkages 256 in an over-centered position as shown in FIG. 2D. In this over-centered position, the piston 234 has moved upward to a bottom end position at or near a bottom of lower piston channel 246, the linkages 256 have rotated into a locked position adjacent the segments 260 and normal to the rods 254, and the segments 260 have rotated into a locked position adjacent a lower end of upper flange 238. The piston 234 may be moved back to the retracted positions of FIGS. 2A-2C, for example, by applying hydraulic pressure to move the piston 234 toward the upper piston channel 244.

In some cases, the segments 260 may be positioned in sealing engagement with an outer surface of the mandrel 233, or extend through the mandrel 233 thereby cutting the mandrel 233. The segments 260 may have inner surfaces 263 for engagement with a neck 265 of the mandrel 233 and/or seals for sealing engagement with the mandrel 233 as shown in FIG. 2D. The inner surfaces 263 may have grooves for gripping engagement with the mandrel 233, cutting tips for cutting through the mandrel 233, and/or seals for sealing engagement with the mandrel 233. The mandrel 233 may have a neck portion 231 for receiving the segments 260. The neck portion 231 may have corresponding grips may be providing on mandrel 233 for receiving the surfaces 263. Various tips, surfaces, grips and combinations may be provided along one or more of the segments 260 for providing desired engagement.

Figure 4:
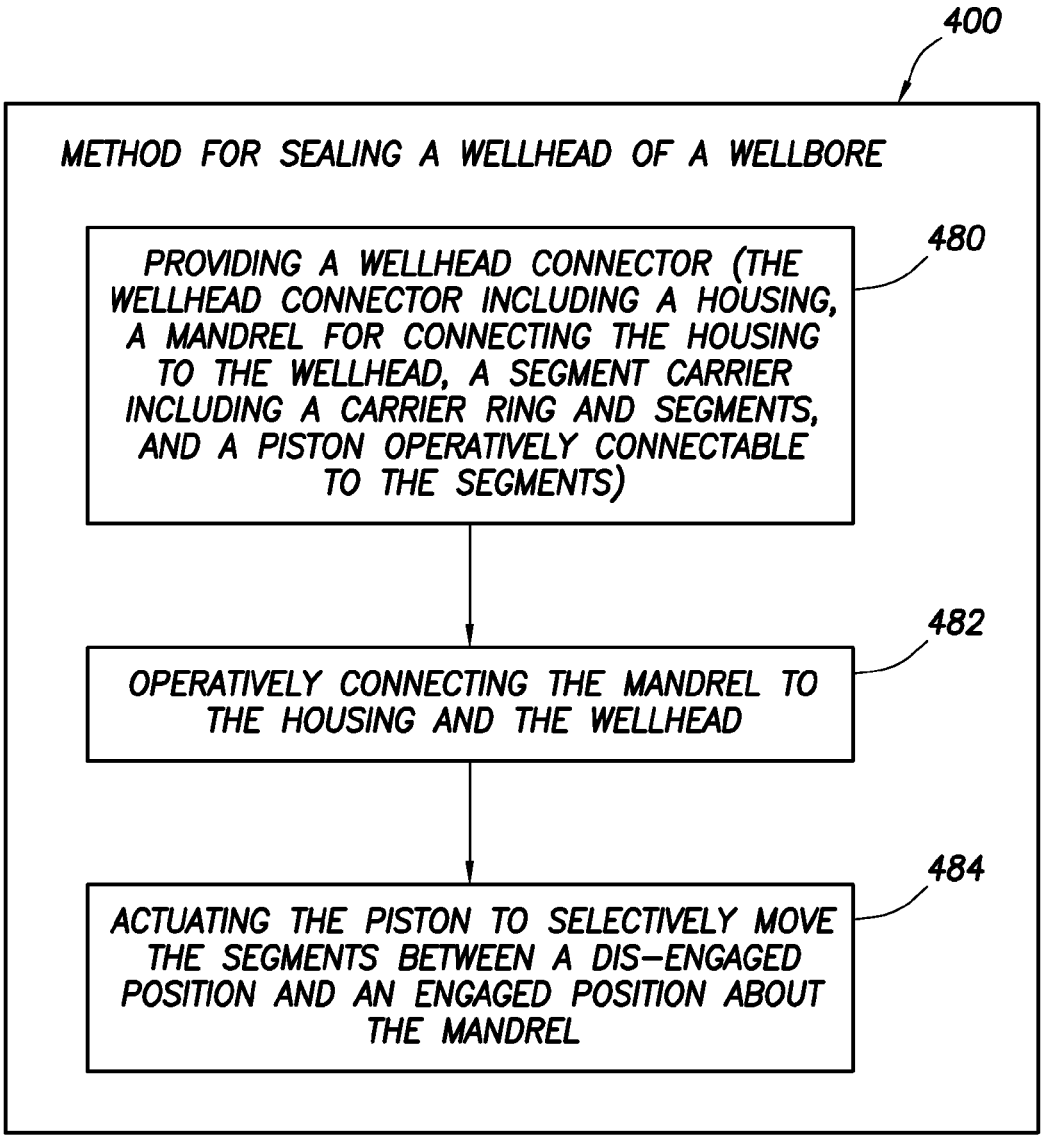
FIG. 4 is a flow chart depicting a method of sealing the wellhead.

FIG. 4 shows a flow chart of a method 400 of sealing a wellhead. The method involves providing 480 a wellhead connector. The wellhead connector includes a housing having a bore therethrough, a mandrel for connecting the housing to the wellhead, a segment carrier positionable in the housing (the segment carrier including a carrier ring and a plurality of segments radially positionable thereabout), and a piston. The method further involves operatively connecting 482 the wellhead connector to the wellhead, and actuating 484 the piston to selectively move the plurality of segments between a disengaged and an engaged position about the mandrel.

The method may also involve sealing, deforming, and/or cutting the mandrel 233 with the segments, slidably moving the piston in the housing and/or self-locking the plurality of segments by over-centering the linkages in the housing. The piston may include a pair of piston rings with a plurality of rods extending therebetween (the plurality of rods operatively connected to the plurality of segments by a plurality of linkages) and the method may further involve slidably moving the piston in the housing such that the linkages rotate the plurality of segments. The steps may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more wellhead connectors, BOPs and/or BOP components may be used to seal the wellhead.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A wellhead connector for a wellhead of a wellbore penetrating a subterranean formation, the wellhead connector comprising:

a housing having a bore therethrough;

a mandrel operatively connectable to the housing and the wellhead, the mandrel having a bore therethrough in fluid communication with the bore of the housing and the wellhead;

a segment carrier positionable in the housing, the segment carrier comprising a carrier ring operatively connectable to the mandrel and a plurality of segments pivotally connectable to the carrier ring and movable radially thereabout;

a plurality of linkages, each of the plurality of linkages having a first end and a second end, the first end pivotally connectable to the plurality of segments; and a piston pivotally connectable to the second end of the plurality of linkages, the piston actuatable to move the plurality of segments via the plurality of linkages between a disengaged and an engaged position about the mandrel whereby the wellhead is selectively sealed.

2. The wellhead connector of claim 1, wherein the piston comprises upper and lower piston rings with a plurality of rods positioned therebetween.

3. The wellhead connector of claim 2, wherein the piston is pressure balanced in the housing.

4. The wellhead connector of claim 1, wherein the plurality of segments are self-lockable by moving the plurality of linkages to an over-centered position normal to the plurality of rods.

5. The wellhead connector of claim 1, wherein in the engaged position the plurality of segments converge, and in the dis-engaged position the plurality of segments diverge about the mandrel.

6. The wellhead connector of claim 1, wherein the plurality of segments comprise cutting tips to cut through at least a portion of the mandrel.

7. The wellhead connector of claim 1, wherein the plurality of segments have contact surfaces to deform the mandrel.

8. The wellhead connector of claim 1, wherein the plurality of segments have seals sealable about the mandrel.

9. The wellhead connector of claim 1, wherein the plurality of segments have grips grippingly engageable about the mandrel.

10. The wellhead connector of claim 1, wherein the mandrel has a neck portion to receive the plurality of segments.

11. The wellhead connector of claim 1, wherein the mandrel has a flange end operatively connectable to the wellhead.

12. The wellhead connector of claim 1, wherein the mandrel is receivable in the housing through the receptacle and operatively connectable to a downhole end of an upper flange of the housing.

13. The wellhead connector of claim 1, wherein the housing comprises a tubular body, an upper flange and a lower receptacle.

14. The wellhead connector of claim 13, further comprising locking dogs operatively connecting the upper flange and the lower receptacle to the tubular body.

15. A wellhead system for a wellhead of a wellbore penetrating a subterranean formation, the wellhead system comprising:

a wellhead connector, comprising:

a housing having a bore therethrough;

a mandrel operatively connectable to the housing and the wellhead, the mandrel having a bore therethrough in fluid communication with the bore of the housing and the wellhead;

a segment carrier positionable in the housing, the segment carrier comprising a carrier ring operatively connectable to the mandrel and a plurality of segments connectable to the carrier ring and pivotally movable radially thereabout;

a plurality of linkages, each of the plurality of linkages having a first end and a second end, the first end pivotally connectable to the plurality of segments; and a piston pivotally connectable to the second end of the plurality of linkages, the plurality of linkages actuatable to move the plurality of segments via the plurality of linkages between a disengaged and an engaged position about the mandrel whereby the wellhead is selectively sealed; and an actuator to actuate the piston.

16. The system of claim 15, further comprising a controller.

17. A method for sealing a wellhead of a wellbore penetrating a subterranean formation, the method comprising:

providing a wellhead connector, the wellhead connector comprising:

a housing having a bore therethrough;

a mandrel having a bore therethrough in fluid communication with the bore of the housing and the wellhead;

a segment carrier positionable in the housing, the segment carrier comprising a carrier ring operatively connectable to the mandrel and a plurality of segments connectable to the carrier ring and pivotally movable radially thereabout;

a plurality of linkages, each of the plurality of linkages having a first end and a second end, the first end pivotally connectable to the plurality of segments; and a piston pivotally connectable to the second end of the plurality of linkages;

operatively connecting the mandrel to the housing and the wellhead; and actuating the piston to selectively move the plurality of segments via the plurality of linkages between a disengaged position and an engaged position about the mandrel.

18. The method of claim 17, wherein the actuating comprises forming a seal about the mandrel with the plurality of segments.

19. The method of claim 17, wherein the actuating comprises deforming the mandrel with the plurality of segments.

20. The method of claim 17, wherein the actuating comprises cutting the mandrel with the plurality of segments.

21. The method of claim 17, wherein the actuating comprises slidably moving the piston in the housing.

22. The method of claim 17, wherein the piston comprises a pair of piston rings with a plurality of rods extending therebetween, the plurality of rods operatively connected to the plurality of segments by the plurality of linkages and wherein the actuating comprises slidably moving the piston in the housing such that the plurality of linkages rotate the plurality of segments.

23. The method of claim 22, further comprising self-locking the plurality of segments by moving the plurality of linkages to an over-centered position normal to the plurality of rods.

24. The method of claim 22, further comprising pressure balancing the piston within the housing.

* * * * *